US007090551B1

(12) United States Patent
Lokken et al.

(10) Patent No.: US 7,090,551 B1
(45) Date of Patent: Aug. 15, 2006

(54) OUTBOARD MOTOR TILLER HANDLE WITH UPWARD POSITION LOCKING DEVICE

(75) Inventors: Mark T. Lokken, Oshkosh, WI (US); Glenn E. Anderson, Omro, WI (US)

(73) Assignee: Brunswick Corporation, Lake Forest, IL (US)

( * ) Notice: Subject to any disclaimer, the term of this patent is extended or adjusted under 35 U.S.C. 154(b) by 104 days.

(21) Appl. No.: 10/954,687

(22) Filed: Sep. 30, 2004

(51) Int. Cl.
*B63H 20/08* (2006.01)
*B63H 5/125* (2006.01)

(52) U.S. Cl. ..... 440/63; 440/84; 440/86; 440/87

(58) Field of Classification Search ..... 440/84, 440/86, 87, 63
See application file for complete search history.

(56) References Cited

U.S. PATENT DOCUMENTS

| | | | | |
|---|---|---|---|---|
| 2,603,981 | A * | 7/1952 | Snyder | 403/157 |
| 3,922,996 | A | 12/1975 | Meyer | 115/18 R |
| 5,797,777 | A | 8/1998 | Tsunekawa et al. | 440/84 |
| 6,093,066 | A | 7/2000 | Isogawa et al. | 440/63 |
| 6,406,342 | B1 | 6/2002 | Walczak et al. | 440/84 |
| 6,406,343 | B1 | 6/2002 | Kawai et al. | 440/86 |

* cited by examiner

*Primary Examiner*—Sherman Basinger
(74) *Attorney, Agent, or Firm*—William D. Lanyi

(57) ABSTRACT

A tiller arm is provided with a lock mechanism that retains the tiller arm in an upwardly extending position relative to an outboard motor when the tiller arm is rotated about a first axis and the lock mechanism is placed in a first of two positions. Contact between an extension portion of the lock mechanism and the discontinuity of the arm prevents the arm from rotating downwardly out of its upward position.

19 Claims, 2 Drawing Sheets

OUTBOARD MOTOR TILLER HANDLE WITH UPWARD POSITION LOCKING DEVICE

BACKGROUND OF THE INVENTION

1. Field of the Invention

The present invention relates generally to a tiller handle and, more particularly, to a tiller handler that is lockable in an upward position relative to a steering component of the outboard motor.

2. Description of the Prior Art

Many different types of tiller handles are well known to those skilled in the art. Typically, the tiller handle is movable about a generally horizontal axis to several positions.

U.S. Pat. No. 3,922,996, which issued to Meyer on Dec. 2, 1975, discloses a steering apparatus for an outboard motor. A steering handle assembly includes a tiller handle having an outer throttle grip with a "kill" switch mounted within the end of the grip. A tubular housing is secured at the inner end of a rotatable elbow support to place the tiller in a raised transport position. A throttle shaft is rotatably mounted within the housing and fixed to the housing.

U.S. Pat. No. 5,797,777, which issued to Tsunekawa et al. on Aug. 25, 1998, describes an outboard motor control. A control handle for the tiller of an outboard motor is described which embodies a twist-grip throttle control, a pivotally supported transmission control and a trim switch. These features are juxtaposed to each other but oriented in such a way so that actuation of one will not affect accidental actuation of any other control.

U.S. Pat. No. 6,093,066, which issued to Isogawa et al. on Jul. 25, 2000, describes a control for an outboard motor. The throttle and transmission control of an outboard motor employs a bowden wire mechanism for transmitting control signals from the tiller handle to the engine throttle and transmission control. The control handle is pivotally mounted on the front end of a tiller arm and the wire actuators exit the control handle and enter the protective cowling on opposite sides of a longitudinal center plane or on opposite sides of the protective cowling so as to increase the length of the wire actuators in this area so as to facilitate their bending without kinking.

U.S. Pat. No. 6,406,343, which issued to Kawai et al. on Jun. 18, 2002, describes a tiller control for an outboard motor. It features a compact throttle control and transmission shifting control on a handle connected to a tiller. An interlock is designed to limit the maximum engine speed at which the engine can be operated when the transmission is in neutral and to lock the transmission in neutral or out of neutral when the engine is operated at a speed greater than a second speed that is less than the maximum speed.

U.S. Pat. No. 6,406,342, which issued to Walczak et al. on Jun. 18, 2002, discloses a control handle for a marine tiller. The control handle is provided with a rotatable handle grip portion that includes an end surface which supports a plurality of push buttons that the operator of a marine vessel can depress to actuate certain control mechanisms and devices associated with the outboard motor. These push buttons include trim up and trim down along with gear selector push buttons in a preferred embodiment of the present invention.

The patents described above are hereby expressly incorporated by reference in the description of the present invention.

The tiller handle of an outboard motor is typically provided with an axis about which it can pivot to various positions. For example, from a generally horizontal position that is typically used when an operator of a marine vessel is operating the outboard motor, the handle can be tilted upwardly so that it is moved out of the way to prevent it from obstructing the space immediately in front of the outboard motor. Another reason for rotating the tiller handle upwardly relative to a steering component of the outboard motor is to more easily allow the outboard motor to be trimmed or tilted about its trim access without causing the tiller handle to move into contact with various components within the marine vessel. In other words, as the outboard motor is rotated about its trim axis, the tiller handle typically rotates about the same trim axis and can move into obstructing relation with portions of the marine vessel or components contained within the marine vessel. When tilting an outboard motor upwardly in this manner, the tiller handle is typically raised to its upward position to avoid these potential disadvantages.

Some outboard motors are used as secondary propulsion devices in combination with a primary propulsion device which is typically a larger outboard motor. This type of secondary outboard motor is referred to by those skilled in the art as a "kicker motor" and is normally used for the purpose of trolling. When not in use, the secondary outboard motor is typically tilted upwardly out of the water with its tiller handle raised to its uppermost position relative to a steering component of the outboard motor. In outboard motors known to those skilled in the art, the tiller handle can easily move out of its upward position under the circumstances and into obstructing contact with the space or components in front of the outboard motor.

It would therefore be beneficial if a system could be provided in which the tiller handle of an outboard motor could be locked in an upward position to remain in that position when the secondary outboard motor, or "kicker motor" is trimmed upwardly relative to the transom of the marine vessel. It would be further beneficial if this locking mechanism could be easily released by the operator of the marine vessel when the secondary motor is intended for use as a propulsion device for the marine vessel.

SUMMARY OF THE INVENTION

A tiller handle, made in accordance with a preferred embodiment of the present invention, comprises an arm portion having a first end and a second end and a handle grip attached to the first end. The second end is rotatably attached to a steering member of an outboard motor for rotation about a first axis. A discontinuity is formed in the second arm portion proximate the second end. A lock mechanism is movably attached to the steering member of the outboard motor. The lock mechanism is movable into at least a first position and a second position. The first position allows the lock mechanism to move into interfering relation with the discontinuity and the second position prevents the lock mechanism from moving into interfering relation with the discontinuity.

The discontinuity which is disposed at the second end of the arm portion can be a depression formed in the surface of the arm. Alternatively, it can be a protrusion extending outwardly from the surface of the arm. The depression is shaped to retain an extension of the lock mechanism therein when the lock mechanism is in the first position and the arm is rotated past a predetermined position relative to the steering member. A positioning device can be disposed in contact with the lock mechanism to urge the lock mechanism toward the first position. The positioning device, in a preferred embodiment of the present invention, is a spring.

The handle grip is rotatable about a rotational axis which extends through the length of the arm and through the first and second ends. The lock mechanism, in a preferred embodiment of the present invention, is manually movable and, in a particularly preferred embodiment of the present invention, is manually rotatable about a second axis. An insert can be provided, in a preferred embodiment of the present invention, which is shaped to be inserted in the depression of the arm to disable the lock mechanism from moving into interfering relation with the discontinuity. The arm can be retained in an upward position relative to the steering member, as a result of the use of the present invention, when the lock mechanism is in the first position and disposed in interfering relation with the discontinuity. The arm is releasable from the upward position relative to the steering member by manually moving the lock mechanism into the second position and manually moving the arm away from the upward position relative to the steering member. In a particularly preferred embodiment of the present invention, a support member is also provided and extends from the lock mechanism. The support member is movable into contact with the arm when the lock mechanism is in the first position and the arm is in its operable steering position relative to the steering member. The support member provides additional support to prevent the arm from moving downwardly away from its operable steering position while the lock mechanism is in its first position.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
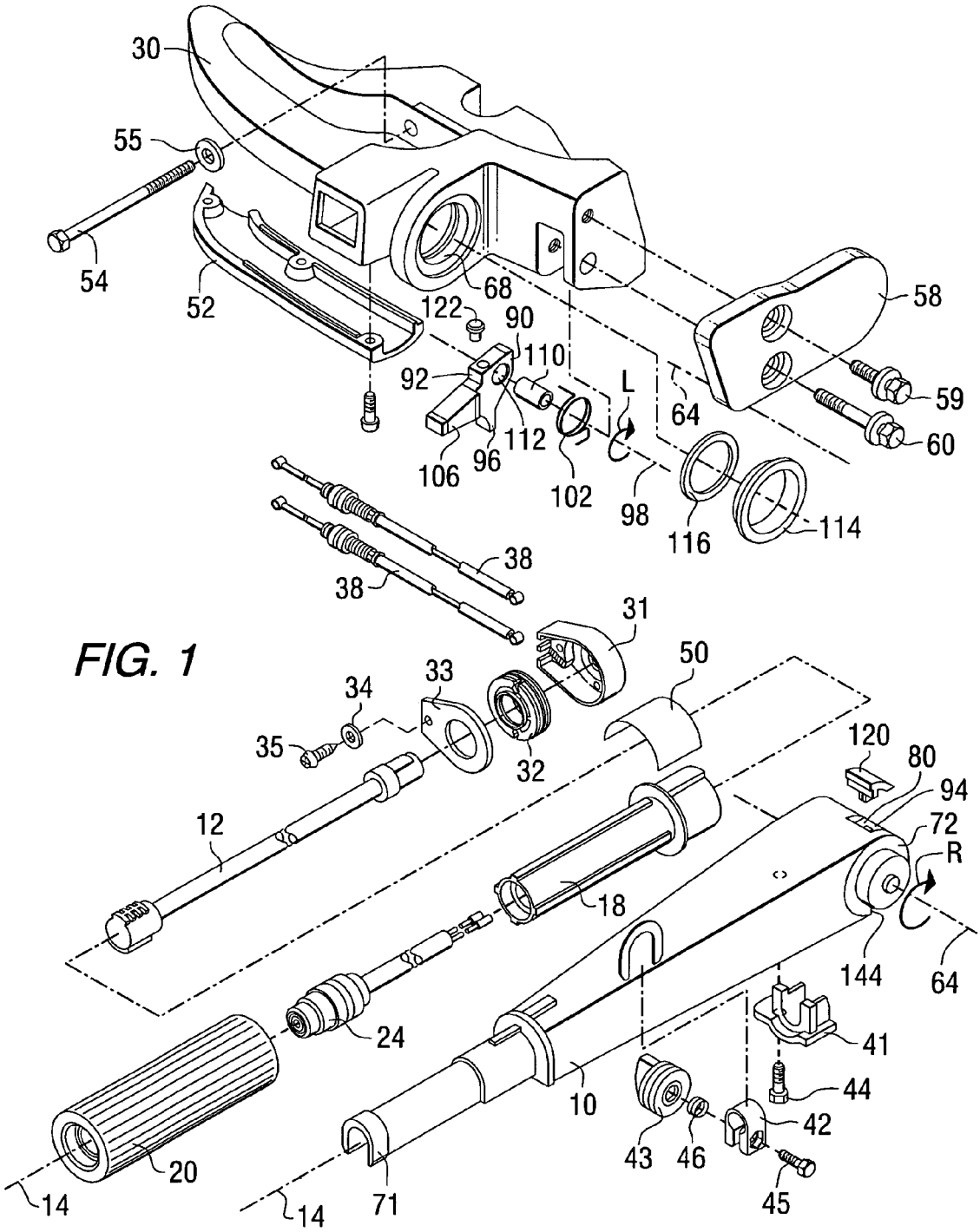
FIG. 1 is an exploded isometric view of the present invention.

Throughout the description of the preferred embodiment of the present invention, like components will be identified by like reference numerals.

FIG. 1 is an isometric exploded view of a preferred embodiment of the present invention. The tiller handle comprises a housing portion, or arm 10, which defines a space within it. In that space, a throttle shaft 12 is supported for rotation about a rotational axis 14. Attached to the throttle shaft 12 is an inner grip 18, an outer grip 20 and a stop switch 24. When assembled together, the outer grip 20, the throttle shaft 12, and the connected components all are rotatable about the rotational axis 14.

Also shown in FIG. 1 is a steering bracket 30, or steering member of an outboard motor, to which the arm of the tiller handle is rotatably attached. The steering bracket 30, as is known to those skilled in the art, is rigidly attached to other portions of an outboard motor. In certain applications, it facilitates the portability of the outboard motor by also providing a handle with which the outboard motor can be lifted. It also provides a connection to which a tiller handle is connected to the outboard motor to allow an operator of a marine vessel to rotate the steering bracket 30 and the other portions of the outboard motor about a steering axis of the outboard motor.

With continued reference to FIG. 1, the components identified by reference numerals 31–35 provide a pulley mechanism that is responsive to rotation of the outer grip 20 about the rotational axis 14. Throttle cables are connected to the pulley 32 for these purposes. Reference numerals 41–46 identify various components that serve to function of supporting the throttle shaft 12 within the housing 10 of the tiller handle. These include the throttle shaft bracket 41, a friction adjusting knob 43, and a friction clamp 42.

With continued reference to FIG. 1, reference numeral 50 identifies a decal which is applied to the outer surface of the housing member 10 to identify various throttle positions for the outer grip 20 relative to the housing 10. In association with the steering bracket 30, a bracket cover 52 is provided. The bolt 54 and washer 55 attach the steering bracket 30, or steering member of the outboard motor, to the main body of the outboard motor (not shown in FIG. 1). A bracket end cover 58 is attachable to the steering bracket 30 by bolts 59 and 60.

With continued reference to FIG. 1, the housing 10, in combination with its connected components, provides an arm that is rotatable about a first axis 64. As shown in FIG. 1, the first axis extends through the arm 10 and is also shown extending through an opening 68 formed in the steering bracket 30. The arm 10 has a first end 71 and a second end 72.

With continued reference to FIG. 1, the handle grip 20 is attached to the first end 71 of the arm and the second end 72 of the arm is rotatably attached to the steering member 30, or steering bracket, of the outboard motor for rotation about the first axis 64. A discontinuity 80 is formed in the arm 10 proximate the second end 72. A lock mechanism 90 is movably attached to the steering member 30 of the outboard motor. The lock mechanism 90 is movable into at least a first position and a second position. When in the first position, an extension 92 of the lock mechanism 90 is allowed to move into interfering relation with the discontinuity 80 formed in the outer surface of the second end 72 of the arm 10. When in the second position, the extension 92 of the lock mechanism 90 is prevented from moving into interfering relation with the discontinuity 80. In the embodiment of the present invention shown in FIG. 1, the discontinuity 80 is a depression formed in the outer surface of the arm 10 at its second end 72. The depression 80 is shaped to retain the extension 92 of the lock mechanism and, as a result, the arm 10 is prevented from rotating out of an upper position relative to the steering bracket 30 whenever the lock mechanism 90 is in its first position and the arm 10 is rotated past a predetermined position relative to the steering member 30. In other words, when the arm 10 is rotated in the direction represented by arrow R in FIG. 1 toward its upward position relative to the steering bracket 30 and the lock mechanism 90 is generally in the position shown in the exploded view of FIG. 1, the extension 92, or blocking surface 92, of the lock mechanism 90 moves into contact with a surface 94 of the discontinuity 80 to prevent rotation of the arm 10 in a direction opposite to that represented by arrow R in FIG. 1. In a preferred embodiment of the present invention, the extension 92 slides along an outer circular surface of the second end 72 of arm 10 until the depression 80 moves to a position where the extension 92 can move into the depression 80 under the urging of spring 102. This is the first position of the lock mechanism 90 which is described above.

Once within the depression 80, the extension 92 blocks movement of the arm 10 in the direction opposite to arrow R because the extension 90 moves against the surface 94 of the depression. It can be seen that this embodiment of the present invention operates according to the principles of a ratchet and pawl mechanism. The extension 92 of the lock mechanism 90 acts as a pawl and the rotating second end 72 of the arm 10, with its depression 80, acts as a ratchet. The extension 92, or pawl member, moves into the depression 80 in a manner generally similar to the way a pawl moves over and between teeth of a ratchet. To release this locking relationship, the tab 96 of the lock mechanism 90 can be manually moved to rotate the lock mechanism 90 in a rotational direction which is generally opposite to that which is indicated by arrow L in FIG. 1. This moves the lock mechanism 90 into its second position and away from its first position. A positioning device 102, which is illustrated as a spring in FIG. 1, urges the lock mechanism 90 in the direction represented by arrow L which causes the lock mechanism 90 to rotate toward its first position. The action of the spring 102 urges the lock mechanism 90 to move in the direction represented by arrow L which places the extension 90 against the rounded surface of the second end 72 of arm 10 and, when the depression 80 moves into location, causes the extension 92 to move into the depression 80 and against surface 94 so that reverse rotation of the arm 10, in a direction opposite to arrow R, is prevented.

A support member 106 is also provided by an extension of the lock mechanism 90. The function of the support member 106 is to assist in supporting the arm 10 and preventing it from rotating in a direction opposite to arrow R when the arm 10 is in its operating position which is generally horizontal. The operation of the support member 106 will be described in greater detail below. Also shown in FIG. 1 is a collar 110 which is disposed within an opening 112 of the lock mechanism 90. A bushing 114 and a washer 116 are also illustrated in FIG. 1.

When the discontinuity 80 is a depression, as illustrated in FIG. 1, and formed in the rounded surface of the second end 72 of arm 10, a plug 120 can be provided in order to disable the operation of the lock mechanism 90. By inserting the plug 120 into the depression 80, the extension 92 of the lock mechanism 90 will slide past and over the depression 80 and the present invention will be rendered inoperative. Certain uses of outboard motors do not benefit from the function performed by the present invention. Therefore, the use of the depression 80 allows the operation of the present invention to be disabled, in those circumstances, by the insertion of the plug 120. Also shown in FIG. 1 is a stopper 122 which is inserted into an opening formed in the lock mechanism 90 in order to provide an elastomeric member (i.e. the stopper 122) which moves against a metallic surface of the steering bracket 30 rather than have the metal surface of the lock mechanism 90 move into direct contact with that metal surface of the steering bracket 30.

Figure 2:
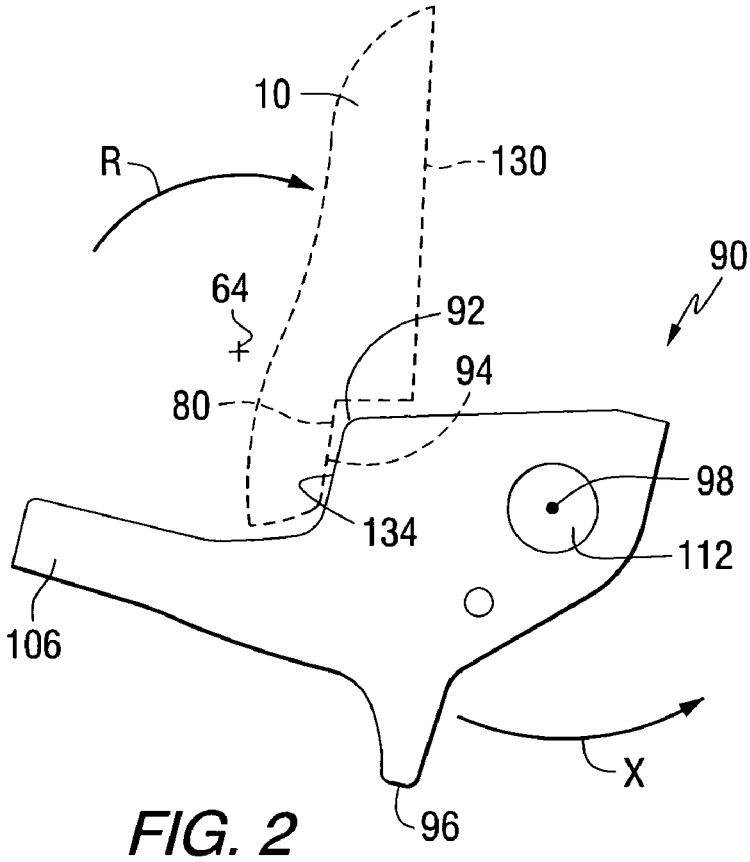
FIG. 2 is an isolated view of a locking mechanism of the present invention shown in association with a dashed line representation of an upward position of a tiller arm.
Figure 3:
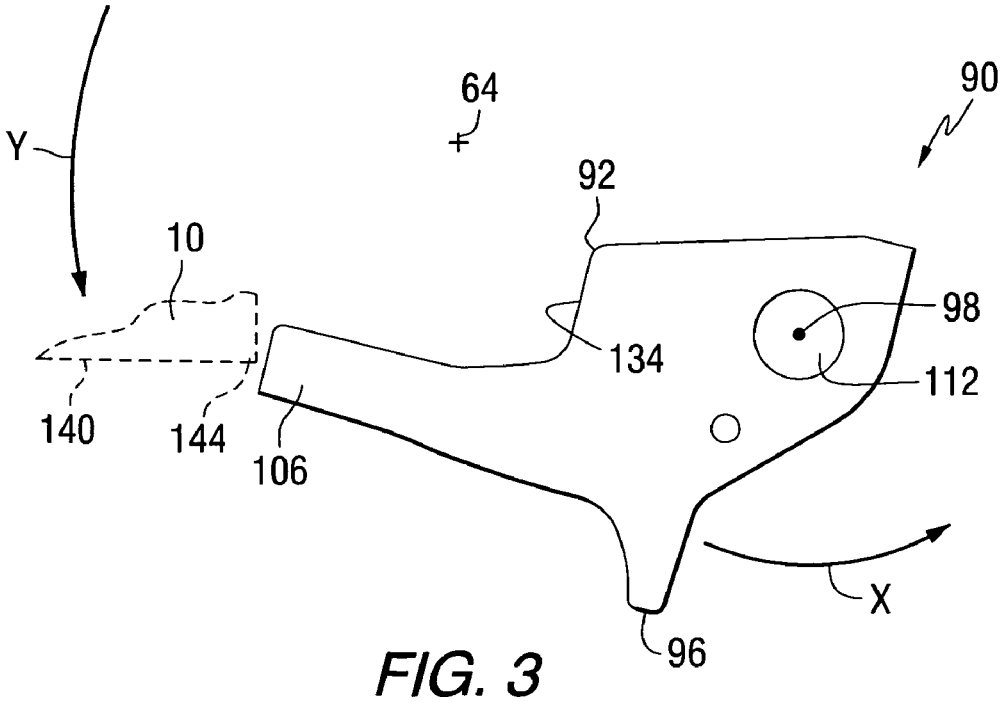
FIG. 3 is an isolated view of a locking mechanism of the present invention shown in association with a dashed line representation of a horizontal position of a tiller arm.

FIGS. 2 and 3 show the lock mechanism 90 in relation to two alternative positions of the arm 10. In FIG. 2, dashed line representation 130 shows the relevant portion of the arm 10 in relation to the lock mechanism 90 when the arm 10 is in its upward position. FIG. 3 shows the lock mechanism 90 relative to a relevant portion of the arm 10 when the arm 10 is in a downward position, such as it would be when the operator of a marine vessel is using the arm 10 to steer the outboard motor and control the throttle. In both FIGS. 2 and 3, only the relevant portions of the arm 10, as represented by dashed line representations 130 and 140, are shown so that the interaction between various surfaces and portions of the lock mechanism 90 can be more clearly illustrated and described.

FIGS. 2 and 3 show the lock mechanism 90 illustrated in association with two dashed line representations of portions of the arm 10 when the arm is in two different positions as will be described below. The dashed line representation identified by reference numeral 130 in FIG. 2 illustrates the position of the discontinuity 80, or depression, of the arm 10 when the arm is raised to an upward directed position relative to the steering bracket 30 (not shown in FIGS. 2 and 3). This upward movement occurs when the arm 10 is rotated about the first axis 64 in the direction illustrated by arrow R in FIGS. 1 and 2. This places the surface 94 of the depression 80 against a surface 134 of the extension 92 of the lock mechanism 90. As a result of the relative positions of surface 94, surface 134, and the second axis 98 about which the lock mechanism 90 pivots, movement of the arm 10 in a direction opposite to arrow R is prevented. If such a movement is attempted, surface 94 will push against surface 134 of the extension 90 in a direction which is generally aligned with the second axis 98 and the position of the lock mechanism 90 will prevent such rotation of the arm 10 in a counterclockwise direction in FIG. 2 about the first axis 64. Relative to the dashed line representation 130 in FIG. 2, the lock mechanism 90 is shown in its first position. A manual force exerted against the tab 96 in the direction represented by arrow X will cause the lock mechanism 90 to rotate in a counterclockwise direction about the second axis 98. This rotation will move surface 134 out of contact with surface 94 and will move the locking mechanism 90 into its second position. As a result, the arm 10 will be able to rotate in a direction opposite to arrow R (i.e. counterclockwise) about the first axis 64. The movement of the lock mechanism 90, in the direction represented by arrow X, can be easily caused by manual force against the tab 96 exerted by the operator of a marine vessel.

With reference to FIG. 3, the dashed line representation identified by reference numeral 140 in FIG. 2 shows a lower portion of the arm 10 which is generally similar to the corner 144 illustrated in FIG. 1 or an analogous extension at the lower portion of the arm 10. When the support member 106 is moved into the position shown in FIG. 3 as a result of the lock mechanism 90 rotating in a clockwise direction about the second axis 98 and into its first position, contact between the corner 144 and the support member 106 prevents further rotation of the arm 10 in the direction represented by arrow Y in FIG. 3. In other words, it prevents the arm 10 from rotating downwardly from its operable position when the operator of a marine vessel is using the arm 10 to steer the outboard motor. By manually pushing the tab 96 in the direction represented by arrow X, the operator of the marine vessel can move the lock mechanism out of the first position in which the support member 106 prevents this continued downward rotation of the arm 10.

With reference to FIGS. 1, 2 and 3, it can be seen that a preferred embodiment of the present invention provides a tiller handle which comprises an arm portion 10 having a first end 71 and a second end 72. A handle grip 20 is attached to the first end 71 and the second end 72 is rotatably attached to a steering member 30 of an outboard motor for rotation about a first axis 64. A discontinuity 80 is formed in the arm 10 at its second end 72. A lock mechanism 90 is movable attached to the steering member 30 of the outboard motor. The lock mechanism 90 is movable into at least a first position and a second position. The first position allows the lock mechanism 90 to move into interfering relation with the discontinuity 80 when its extension 92 moves against surface 94 of the discontinuity 80. The second position prevents the lock mechanism 90 from moving into this interfering relation with the discontinuity 80. The discontinuity disposed at the second end 72 of the arm 10 can be a depression 80 in a preferred embodiment of the present invention. The depression is formed in the surface of the arm 10. The depression 80 is shaped to retain the extension 92 of the lock mechanism 90 therein when the lock mechanism 90 is in its first position and when the arm 10 is rotated in a direction represented by arrow R past a predetermined position relative to the steering member 30. A positioning device 102 is disposed in contact with the lock mechanism 90 to urge the lock mechanism toward the first position. The positioning device 102 is a spring in a preferred embodiment of the present invention. The handle grip 20 is rotatable about a rotational axis 14 which extends through the length of the arm 10 through the first and second ends, 71 and 72, in a preferred embodiment of the present invention. The lock mechanism 90 is manually movable and, in a preferred embodiment of the present invention, is manually rotatable about a second axis 98. An insert 120 is shaped to be inserted into the depression 80 to disable the lock mechanism 90 from moving into interfering relation with the discontinuity 80. The arm 10 is retained in an upward position relative to the steering member 30 when the lock mechanism 90 is in the first position and disposed in interfering relation with the discontinuity 80. The arm 10 is releasable from the upward position relative to the steering member 30 by manually moving the lock mechanism 90 into the second position and manually moving the arm 10 away from the upward position relative to the steering member 30. A support member 106 extends from the lock mechanism 90. The support member 106 is movable into contact with the arm 10 when the lock mechanism 90 is in its first position and the arm 10 is in its operable steering position relative to the steering member 30.

Although the present invention has been described with considerable specificity and illustrated to show a particularly preferred embodiment, it should be understood that alternative embodiments are also within its scope.

We claim:

1. A tiller handle, comprising:

an arm having a first end and a second end;

a handle grip attached to said first end, said second end being rotatably attached to a steering member of an outboard motor for rotation about a first axis;

a discontinuity formed in said arm proximate said second end;

a lock mechanism movably attached to said steering member of said outboard motor, said lock mechanism being movable into at least a first position and a second position, said first position allowing said lock mechanism to move into interfering relation with said discontinuity, said second position preventing said lock mechanism from moving into interfering relation with said discontinuity; and a positioning device disposed in contact with said lock mechanism to urge said lock mechanism toward said first position.

2. The tiller handle of claim 1, wherein:

said discontinuity disposed at said second end of said arm is a depression formed in said arm, said depression being shaped to retain an extension of said lock mechanism therein when said lock mechanism is in said first position and said arm is rotated past a predetermined position relative to said steering member.

3. The tiller handle of claim 2, further comprising:

an insert which is shaped to be inserted in said depression to disable said lock mechanism from moving into interfering relation with said discontinuity.

4. The tiller handle of claim 1, wherein:

said positioning device is a spring.

5. The tiller handle of claim 1, wherein:

said handle grip is rotatable about a rotational axis which extends through the length of said arm and through said first and second ends.

6. The tiller handle of claim 1, wherein:

said lock mechanism is manually movable.

7. The tiller handle of claim 1, wherein:

said lock mechanism is manually rotatable about a second axis.

8. The tiller handle of claim 1, wherein:

said arm is retained in an upward position relative to said steering member when said lock mechanism is in said first position and disposed in interfering relation with said discontinuity.

9. The tiller handle of claim 8, wherein:

said arm is releasable from said upward position relative to said steering member by manually moving said lock mechanism into said second position and manually moving said arm away from said upward position relative to said steering member.

10. The tiller handle of claim 1, further comprising:

a support member extending from said lock mechanism, said support member being movable into contact with said arm when said lock mechanism is in said first position and said arm is in its operable steering position relative to said steering member.

11. A tiller handle, comprising:

an arm having a first end and a second end;

a handle grip attached to said first end, said second end being rotatably attached to a steering member of an outboard motor for rotation about a first axis;

a discontinuity formed in said arm proximate said second end;

a lock mechanism movably attached to said steering member of said outboard motor, said lock mechanism being movable into at least a first position and a second position, said first position allowing said lock mechanism to move into interfering relation with said discontinuity, said second position preventing said lock mechanism from moving into interfering relation with said discontinuity, said discontinuity disposed at said second end of said arm being a depression formed in said arm, said depression being shaped to retain an extension of said lock mechanism therein when said lock mechanism is in said first position and said arm is rotated past a predetermined position relative to said steering member; and a spring disposed in contact with said lock mechanism to urge said lock mechanism toward said first position.

12. The tiller handle of claim 11, wherein:

said handle grip is rotatable about a rotational axis which extends through the length of said arm and through said first and second ends.

13. The tiller handle of claim 12, wherein:

said lock mechanism is manually movable.

14. The tiller handle of claim 13, wherein:

said lock mechanism is manually rotatable about a second axis.

15. The tiller handle of claim 14, wherein:

said arm is retained in an upward position relative to said steering member when said lock mechanism is in said first position and disposed in interfering relation with said discontinuity, said arm being releasable from said upward position relative to said steering member by manually moving said lock mechanism into said second position and manually moving said arm away from said upward position relative to said steering member.

16. The tiller handle of claim 15, further comprising:

a support member extending from said lock mechanism, said support member being movable into contact with said arm when said lock mechanism is in said first position and said arm is in its operable steering position relative to said steering member.

17. A tiller handle, comprising:

an arm having a first end and a second end;

a handle grip attached to said first end, said second end being rotatably attached to a steering member of an outboard motor for rotation about a first axis;

a discontinuity formed in said arm proximate said second end;

a lock mechanism movably attached to said steering member of said outboard motor, said lock mechanism being manually rotatable about a second axis, said lock mechanism being movable into at least a first position and a second position, said first position allowing said lock mechanism to move into interfering relation with said discontinuity, said second position preventing said lock mechanism from moving into interfering relation with said discontinuity, said discontinuity disposed at said second end of said arm being a depression formed in said arm, said depression being shaped to retain an extension of said lock mechanism therein when said lock mechanism is in said first position and said arm is rotated past a predetermined position relative to said steering member, said arm being retained in an upward position relative to said steering member when said lock mechanism is in said first position and disposed in interfering relation with said discontinuity, said arm being releasable from said upward position relative to said steering member by manually moving said lock mechanism into said second position and manually moving said arm away from said upward position relative to said steering member; and a spring disposed in contact with said lock mechanism to urge said lock mechanism toward said first position.

18. The tiller handle of claim 17, wherein:

said handle grip is rotatable about a rotational axis which extends through the length of said arm and through said first and second ends.

19. The tiller handle of claim 18, further comprising:

a support member extending from said lock mechanism, said support member being movable into contact with said arm when said lock mechanism is in said first position and said arm is in its operable steering position relative to said steering member.

* * * * *